US011767685B2

(12) United States Patent
Baeza

(10) Patent No.: US 11,767,685 B2
(45) Date of Patent: Sep. 26, 2023

(54) FENCING SYSTEM FOR NEGOTIATING TOPOGRAPHY OF SURFACES

(71) Applicant: Leonel Baeza, Alpine, TX (US)

(72) Inventor: Leonel Baeza, Alpine, TX (US)

( * ) Notice: Subject to any disclaimer, the term of this patent is extended or adjusted under 35 U.S.C. 154(b) by 0 days.

(21) Appl. No.: 16/725,923

(22) Filed: Dec. 23, 2019

(65) Prior Publication Data

US 2020/0199906 A1 Jun. 25, 2020

Related U.S. Application Data

(60) Provisional application No. 62/783,889, filed on Dec. 21, 2018.

(51) Int. Cl.

| | |
|---|---|
| ***E04H 17/20*** | (2006.01) |
| ***E04H 17/10*** | (2006.01) |
| ***E04H 17/14*** | (2006.01) |
| ***E04H 17/02*** | (2006.01) |

(52) U.S. Cl.

CPC ..... *E04H 17/23* (2021.01); *E04H 17/02* (2013.01); *E04H 17/10* (2013.01); *E04H 17/1448* (2021.01)

(58) Field of Classification Search

CPC ..... E04H 17/02; E04H 17/04; E04H 17/045; E04H 17/08; E04H 17/1448; E04H 17/20; E04H 17/23

See application file for complete search history.

(56) References Cited

U.S. PATENT DOCUMENTS

| | | | | | |
|---|---|---|---|---|---|
| 560,364 | A * | 5/1896 | Owens | E04H 17/08 | |
| 2,690,326 | A * | 9/1954 | Kranick | E06B 11/02 | 52/149 |
| 3,159,248 | A * | 12/1964 | Biehn | E04H 17/08 | 52/165 |
| 3,655,167 | A * | 4/1972 | Skille | E04H 17/08 | 256/35 |
| 4,398,840 | A * | 8/1983 | French | E06B 11/02 | 256/73 |
| 4,763,879 | A * | 8/1988 | Wasicek | E04H 17/08 | 256/70 |

(Continued)

FOREIGN PATENT DOCUMENTS

| | | | | |
|---|---|---|---|---|
| DE | 94 10 107 | * 11/1994 | ..... | E04H 17/14 |

*Primary Examiner* — Michael P Ferguson

(74) *Attorney, Agent, or Firm* — Miguel Villarreal, Jr.; Gunn, Lee & Cave, P.C.

(57) ABSTRACT

A flexible fencing system capable of negotiating topographical variations of surfaces without any negative effect on the strength of the fencing system and comprised of an initial post, at least one intermediary post and an end post. Each of the initial and end posts includes a plate extending distally from the posts. The intermediary posts include two plates extending distally from the intermediary posts where the angle between the distally extending plates is 180°. Braces having plates at each end are located between and connect to the posts at connection points formed by the plates of the braces secured to the plates of the posts. The connection points form a hinge providing flexibility to either incline or decline the brace relative to the preceding post, the variation of the brace inclination or declination determined by the topographical variations of a surface.

7 Claims, 12 Drawing Sheets

(56) References Cited

U.S. PATENT DOCUMENTS

| | | | | |
|---|---|---|---|---|
| 5,061,109 | A * | 10/1991 | Miller | E04H 17/08 403/36 |
| 6,705,598 | B2 * | 3/2004 | Collins | E04H 17/08 256/65.05 |
| 6,779,782 | B1 * | 8/2004 | Webb | E04F 11/1834 256/65.03 |
| 7,070,136 | B1 * | 7/2006 | Bailey | E04H 17/1413 241/260.1 |
| 9,151,074 | B2 * | 10/2015 | Walters | E04H 17/1417 |
| 2016/0145892 | A1 * | 5/2016 | McCarty | E04H 17/20 256/26 |

* cited by examiner

H-BRACE KITS

SIDE VIEW ON BRACE

TOP VIEW OF BRACE

FENCING SYSTEM FOR NEGOTIATING TOPOGRAPHY OF SURFACES

CROSS REFERENCE TO RELATED APPLICATIONS

This original non-provisional application claims priority to and the benefit of U.S. provisional application Ser. No. 62/783,889, filed Dec. 21, 2018, and entitled "Fencing System for Negotiating Topography of Surfaces," which is incorporated by reference herein.

STATEMENT REGARDING FEDERALLY SPONSORED RESEARCH OR DEVELOPMENT

None.

BACKGROUND OF THE INVENTION

1. Field of the Invention

The present invention relates to fences. More particular, the present invention relates to a fencing system for negotiating topographical variations of surfaces.

2. Description of the Related Art

Several types of fences currently exist. One type of fence is what is known as an "H" brace type fence. Installers of current fences used have to follow the contours of the land. This means that the resulting fence may not necessarily be laid in a straight line. The fence may need to curve around certain elevations or depressions in the earth, affecting the area being fenced. What may have been intended to be a straight line may end up having a substantial amount of curve in a fence due to the topographical variations of the surface upon which a fence is laid.

Indeed, it may be that, due to terrain, a fence may not even be feasible at a particular location. This would be especially true if the intended fence was to be laid near a cliff on a mountain top and either the lay of the land would not be conducive to the placement of a fence at that location—e.g., the topography essentially forces the fence to veer off in a direction going off the cliff and thus cannot be laid—or if the heavy machinery typically used in fencing jobs (e.g., trucks, cranes, bulldozers, tractors, cranes, generators) are not able to reach the location of the fence.

In these instances, either the fence desired cannot be laid, or, if the fence can be installed, it will not be as desired by the user, or may be installed improperly, e.g., skewing property lines between adjoining property (fencing either too much over or not enough).

Therefore, there is a need for a robust fencing system that is less demanding in terms of reliance on heavy machinery (and thus, saves time and money—in terms of less manpower needed to install) and which, when laid, is further capable of negotiating topographical variations of surfaces without any negative effect on the strength of the fencing system.

BRIEF SUMMARY OF THE INVENTION

The present invention addresses the shortcomings of the prior art. The present invention is a flexible fencing system that can be laid down in rough terrain, such as high up in the mountains, and can negotiate topographical variations of surfaces, e.g., elevations or depressions in the land, without any negative effect on the strength of the fencing system, all in a straight line. The present invention includes a starting or initial post, at least one intermediary post and an end post. In one embodiment, each of the initial and end posts includes a plate extending distally from the posts. The intermediary posts include two plates extending distally from the intermediary posts where the angle between the distally extending plates is 180°. Braces having plates at each end are located between the posts. Each plate for all posts and braces includes a hole or aperture therein configured to accommodate a fastener, such as a bolt. The braces removably connect to the posts at connection points formed by the plates of the braces aligned with the plates of the posts. The connection points form a hinge via the fastener that traverses through the apertures of the plates and secures the brace plates to the post plates. This hinge provides flexibility to either raise the brace (such that the brace continues in an inclining plane relative to the preceding post) or lower the brace (such that the brace continues in a declining plane relative to the preceding post), the variation of the brace inclination or declination determined by the topographical variations of a surface.

The present invention can negotiate certain topographical elevations and depressions, e.g., hills, or holes or indentions, such as valleys, that appear along the line where the fence is being laid (i.e., the fence line). Hinges formed at the connection point between the posts and braces in between the posts allow for the flexibility of the fencing system. The fencing system of the present invention is extendable for as long as the user needs.

DETAILED DESCRIPTION OF THE INVENTION

Figure 1:
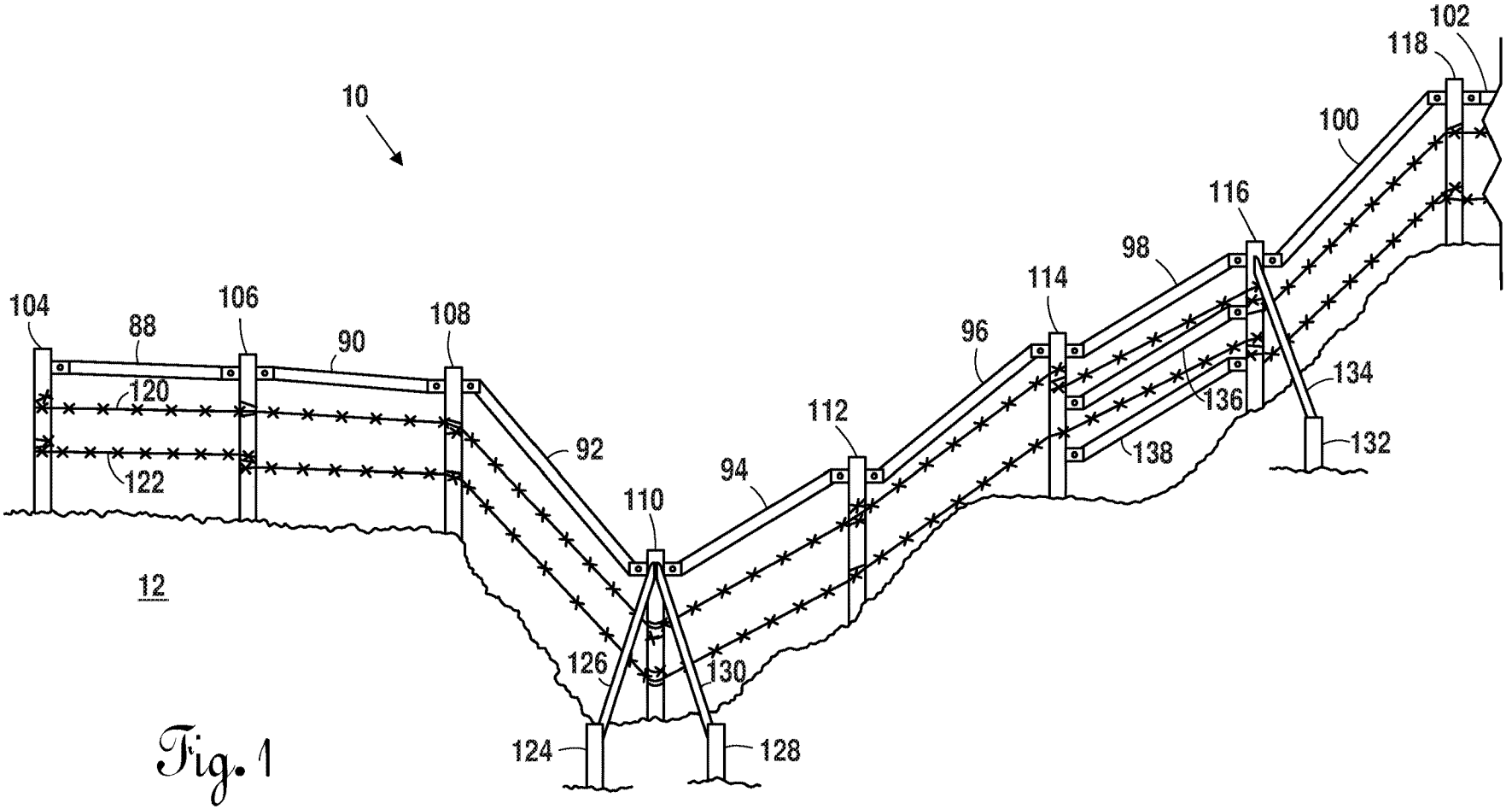
FIG. 1 depicts a perspective environmental view of the present invention.

Referring now to FIG. 1, fencing system 10 of the present invention is shown negotiating over ground or terrain 12. A general overview of fencing system 10 is shown with a more detailed description of the various components of fencing system 10 described below. Initially, and viewing FIG. 1 from left to right, terrain 12 is relatively flat. However, soon, terrain 12 dips down into a valley. Fencing system 10 negotiates this depression in terrain 12. Terrain 12 soon thereafter increases in elevation to a hill and continues until a plateau reached. Fencing system 10 follows the contours of terrain 12 out of the valley and up the hill, as shown in FIG. 1.

Figure 2:
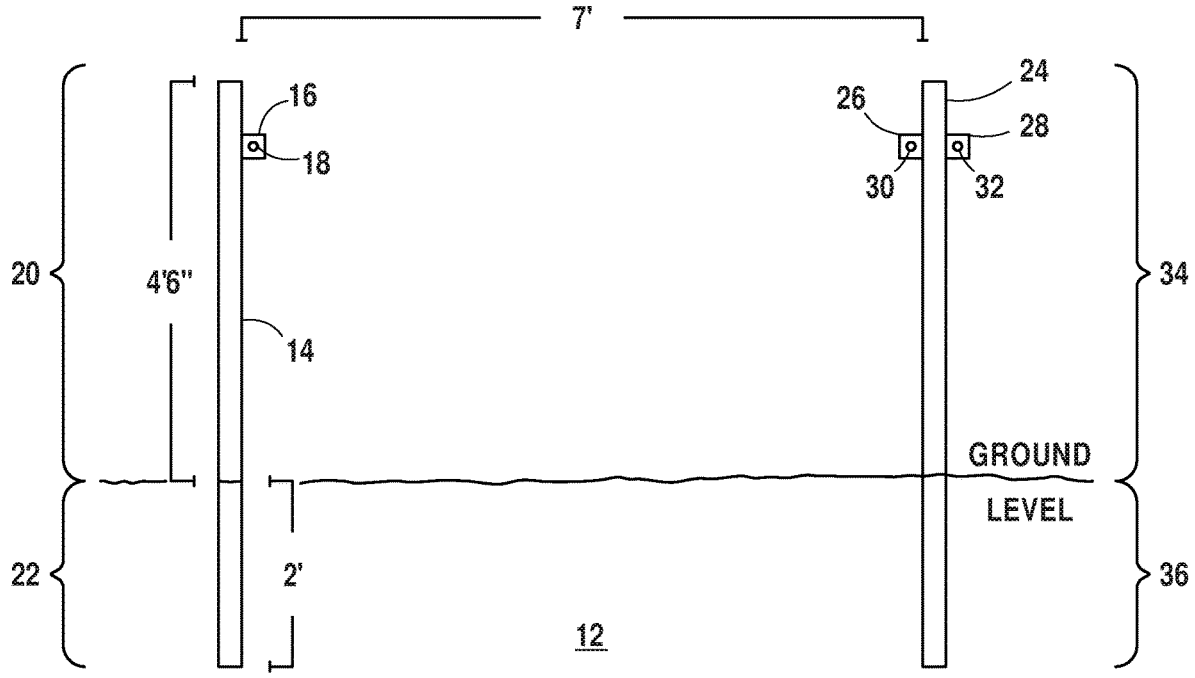
FIG. 2 depicts an elevation view of an embodiment of the present invention.

Referring now to FIG. 2, fencing system 10 of the present invention is comprised of at least one post 14 having an "ear" or plate member 16 extending distally therefrom located in at least one location on post 14. The distally extending member 16 has an aperture 18 therein for receiving a fastener (not shown). This post with distally extending member 16 is the start (or first or initial post 14) of fencing system 10. Initial post 14 has above ground portion 20 exposed and below ground portion 22 below ground 12. Similarly, intermediary post 24 also has above ground portion 34 exposed and below ground portion 36 below ground 12. The height (i.e., above ground portion) of initial post 14 and of the at least one intermediary post 24 may vary depending on the user preference, but may extend upward approximately 4 foot 6 inches in height from ground 12. The depth (i.e., below ground portion) of initial post 14 and of the at least one intermediary post 24 extend into the earth at least 2 feet, as shown in FIG. 2.

Still referring to FIG. 2, fencing system 10 may also comprise at least one intermediary post 24 having a plurality of plate members 26 and 28 extending distally therefrom (and at 180° from each other). While FIG. 2 shows two plate members, additional plate members may also be included. These additional plate members (not shown) would be located at various locations vertically along the at least one intermediary post 24, generally in equal spatial separation. Each distally extending member 26 and 28 of the at least one intermediary post 24 also contains apertures 30 and 32, respectively, therein for receiving a fastener (not shown). These apertures 30 and 32 are similar in size as aperture 18 in distally extending member 16 located on initial post 14. The at least one intermediary post 24 is located and spaced apart from initial post 14 at a predetermined distance.

Figure 3A:
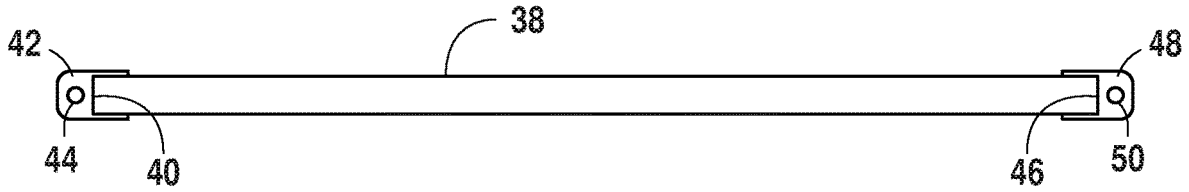
FIGS. 3A and 3B depict the side and top views, respectively, of a brace used in an embodiment of the present invention.
Figure 3B:
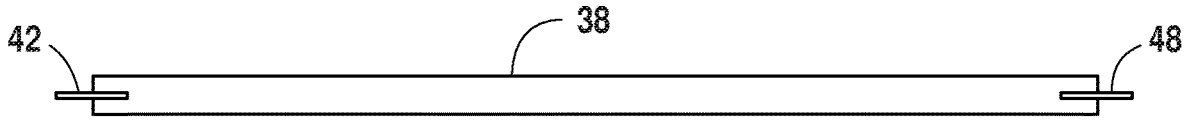

Referring now to FIGS. 3A and 3B, fencing system 10 may also comprise a brace 38. Brace 38 has plates 42 and 48 extending therefrom at each end 40 and 46 of brace 38. Each plate 42 and 48 at either end 40 and 46 of brace 38 further contains apertures 44 and 50 similar in size to aperture 18 of initial post 14 and apertures 30 and 32 of at least one intermediary post 24.

The plate members attached to the post and braces may be welded such that initial post 14 and plate member 16 may constitute a single component. Similarly, brace 38 and plate members 42 and 48 may also be welded together to constitute a single component. Plates 42 and 48 are wider than the outer diameter of brace 38 such that plates 42 and 48 extend beyond the outer diameter of brace 38 when welded together.

Figure 4:
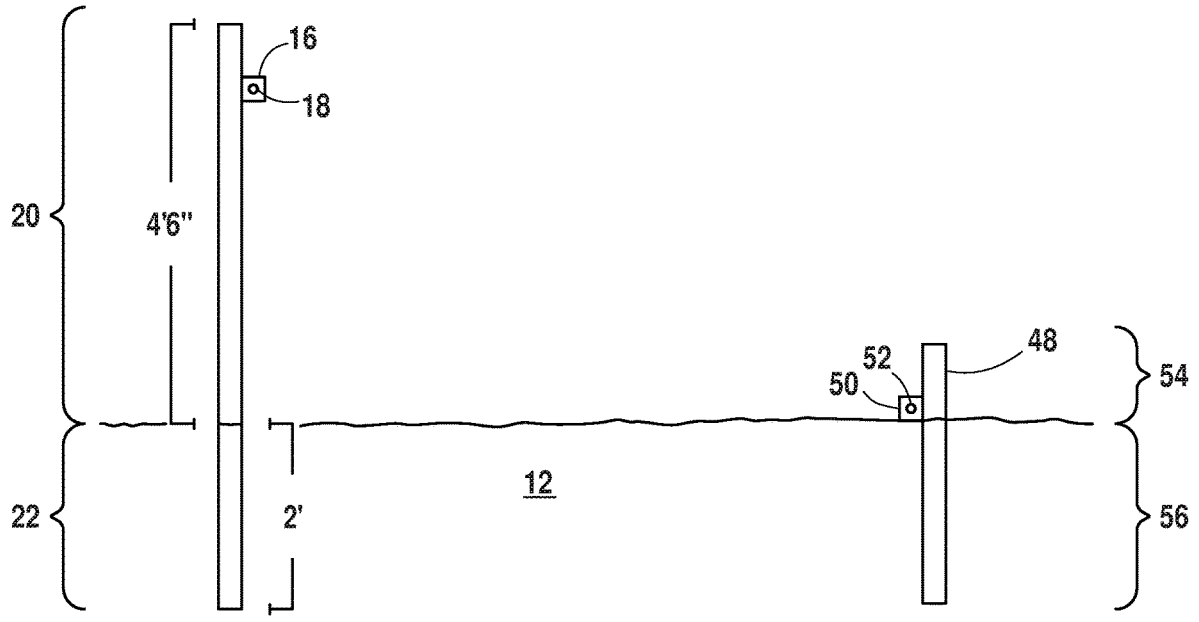
FIG. 4 shows an elevation view of an embodiment of the present invention incorporating the use of a dead man's post.

Referring now to FIG. 4, initial post 14 has above ground portion 20 exposed and below ground portion 22 below ground or terrain 12. Brace post (or dead man's post) 48 has above ground portion 54 and below ground portion 56. However, while the height of brace post 48 is significantly less than the height of initial post 14 (as compared by above ground portion 20 and above ground portion 54), below ground portions 22 and below ground portion 56 are embedded at and penetrate an equal distance into the earth.

The posts of the present invention—whether initial post, intermediary post, end post or brace post (i.e., dead man's post)—use a 2⅜ inch pipe (steel), which can be painted. The height of the posts are variable depending upon customer preference.

The "ear" or plate members extending distally from the initial post and the intermediary posts are 0.25"×3" in dimension. These plate members are welded to the posts.

The apertures which traverse through the plates of the post and of the braces are configured to fit an 8¾ inch bolt made up of hardened steel. A washer and lock washer are also used to ensure the bolts used remain securely fastened.

Figure 5:
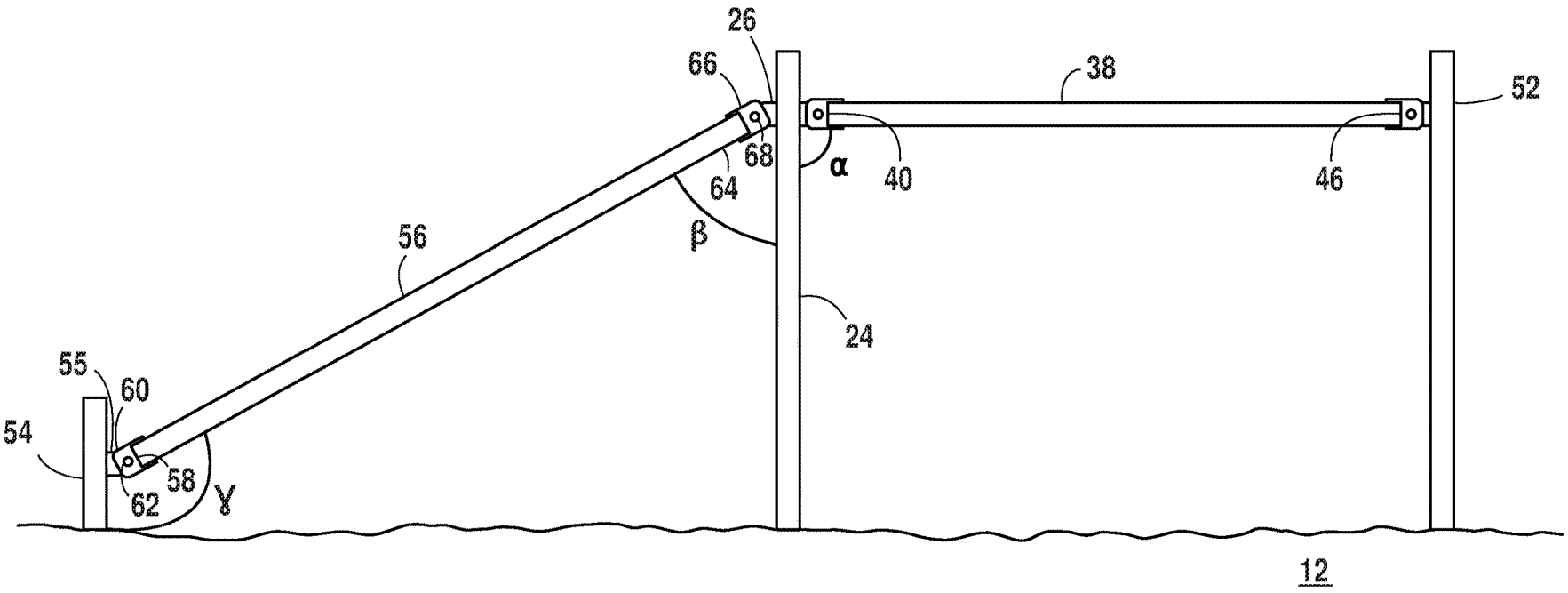
FIG. 5 depicts an elevation view of a portion of an embodiment of the present invention showing angles of braces between posts and with respect to the dead man's post.

Referring now to FIG. 5, end post 52 and intermediary post 24 are removably connected via brace 38 therebetween by aligning the plate member at one end of the brace to the plate member extending distally from a post such that the apertures in each of the plate members are concentrically aligned. The point at which the plate member of the brace connects to the plate member of the post is called a connection point. A fastener or bolt having a washer then traverses the apertures of the plate members. A lock washer and nut are used to securely fastened against the opposite end of the plate members and hold the bolt in place. This configuration of having two posts with a brace in between forms an "H" configuration, as shown in FIG. 5.

Brace 38 is configured to be parallel to terrain 12 as terrain 12 is relatively flat and no adjustment to the level of brace 38 between end post 52 and intermediary post 24 is necessary. The angle $\alpha$ formed by brace 38 and intermediary post 24 is 90° or very near 90° (if slight variations of terrain 12 are encountered but terrain 12 remains relatively flat).

Brace post 54 is removably connected to intermediary post 24 via brace 56 therebetween. Plate 26 of intermediary post 24 aligns with plate 66 at end 64 of brace 56 with a fastener traversing aperture 68 of brace 56 and the aperture of intermediary post 24 to removably secure brace 56 to intermediary post 24. A hinge is formed at this connection point.

Similarly, and still referring to FIG. 5, plate 55 of brace post 54 aligns with plate 60 at end 58 of brace 56 with a fastener traversing aperture 62 of brace 56 and the aperture of brace post 54 to form a hinge and to removably secure brace 56 to brace post 54. As brace post 54 is considerably shorter than intermediary post 24, the hinge at the connection point between brace 56 and intermediary post 24 must be adjusted such that the angle $\beta$ formed between brace 56 and intermediary post 24 is acute, or less than 90°. Conversely, the angle $\gamma$ formed by brace 56 and brace post 54 is obtuse, or greater than 90°.

Figure 6:
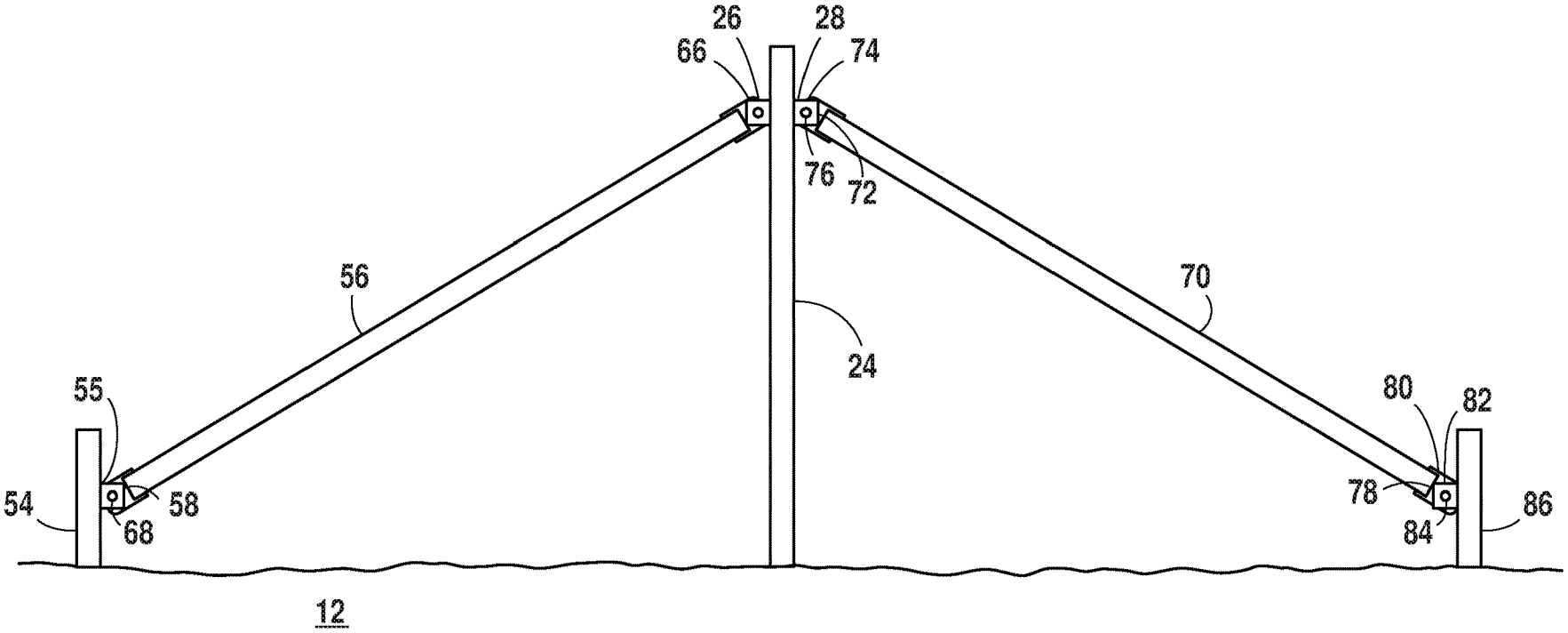
FIG. 6 shows an elevation view of an embodiment of the present invention incorporating the use of a plurality of dead man's posts in line with a fence line.

In a different embodiment, multiple brace posts may be used. Referring now to FIG. 6, intermediary post 24 is secured to two brace posts or dead man's posts 54 and 86 via braces 56 and 70. The posts are connected via braces in the manner just described forming hinges therebetween at the connection points. Brace posts 54 and 86 may be along the fence line (fence not shown), as shown in FIG. 6, to prevent intermediary post 24 from leaning right or left.

Figure 7:
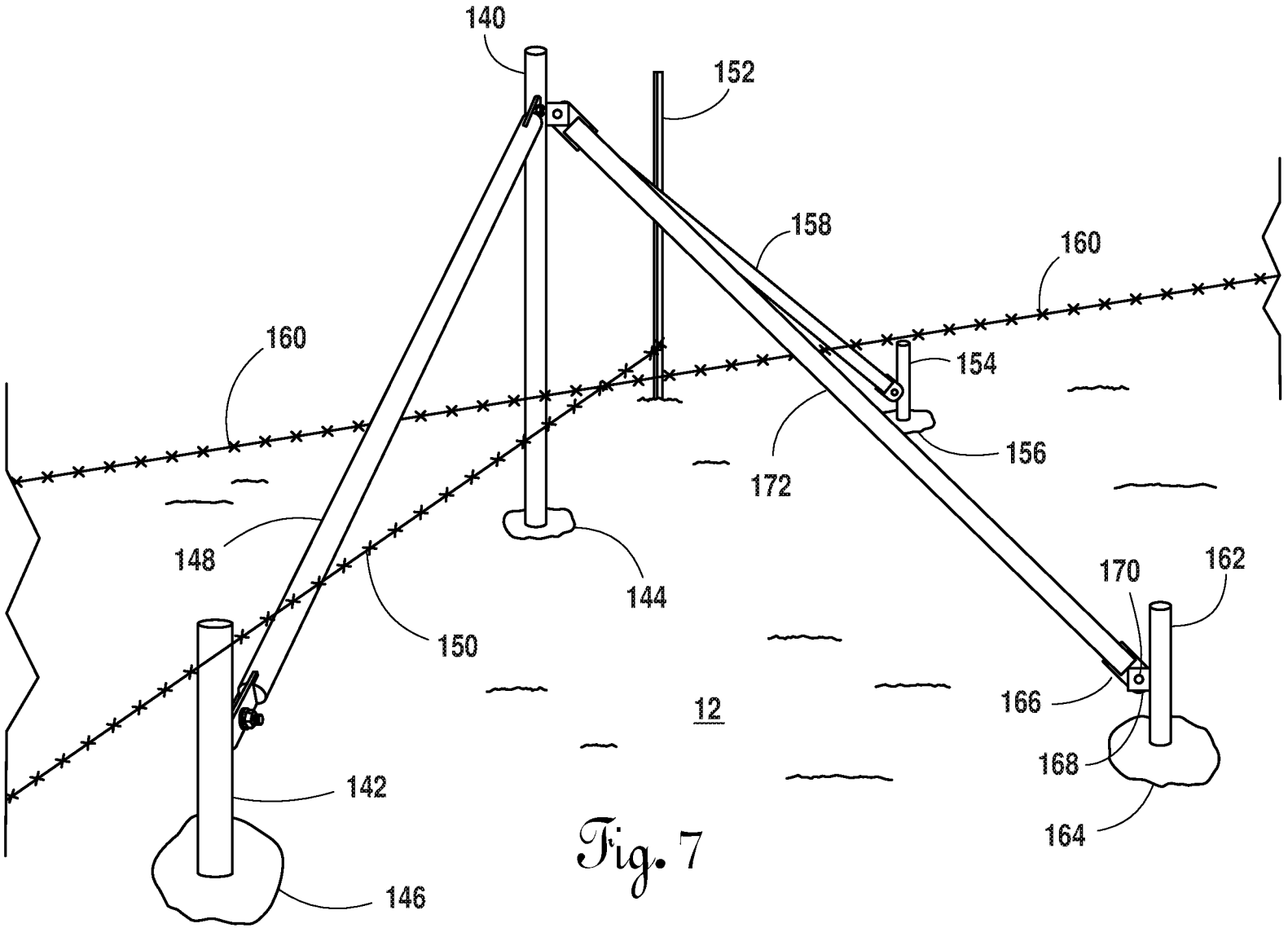
FIG. 7 depicts an embodiment of the present invention incorporating the use of a plurality of dead man's posts within and outside of the fence line.

In still a different embodiment, brace posts may be both within and outside the fence line. Referring now to FIG. 7, intermediary post 140 is secured in terrain 12 via cementitious material 144. Brace post 142 is anchored into terrain 12 via cementitious material 148. Brace post 142 attaches to intermediary post 140 via brace 148. Fence wire 150 traverses along the same plane formed by intermediary post 140 and brace post 142 and passes along the same side of intermediary post 140 and brace post 142. In this instance, fence wire 150 continues until tied off at fence marker 152.

Brace post 154 is securely anchored into terrain 12 via cementitious material 156. Brace 158 connects intermediary post 140 to brace post 154. Fence wire 160 traverses along the same plane formed by intermediary post 140 and brace post 154 and passes along the same side of intermediary post 140 and brace post 154.

Brace post 162 is securely anchored into terrain 12 via cementitious material 164. Brace 172 connects intermediary post 140 to brace post 154. Plate 166 of brace 172 is oriented next to plate 168 of brace post 162 such as to align the apertures of each to allow fastener 170 to traverse thereto thereby removably securing brace 172 to brace post 162. Each of braces 148, 158 and 172 similarly connects to intermediary post 140. Brace post 162 is outside the fence line and provides structural support and reinforcement to intermediary post 140 by preventing intermediary post 140 from leaning away from or toward brace post 162. Although a single fence wire 150 or 160 is shown, multiple fence wires may be used and still be within the contemplation of the present invention.

The fencing system of the present invention provides the structural support for the fencing used. Further, the fencing system of the present invention lays the path for which the fencing wire follows. For example, and referring now to FIG. 8, intermediary posts 174 and intermediary post 186 are within the same plane. However, intermediary post 186 and intermediary post 188 are within a different plane. As fencing wires 194, 196, 198 and 200 come to intermediary post 186 from intermediary post 188, intermediary post 186 is braced with brace 192 (along the fence line) and brace 190 (outside of fence line). As intermediary post 174 is in a different plane (i.e., the fence line turns or curves in a different direction), fence wires 194, 196, 198 and 200 pull against intermediary post 186 to negotiate the change in direction and continue toward intermediary post 174 (of which only fence wire 200 is shown to continue).

Figure 8:
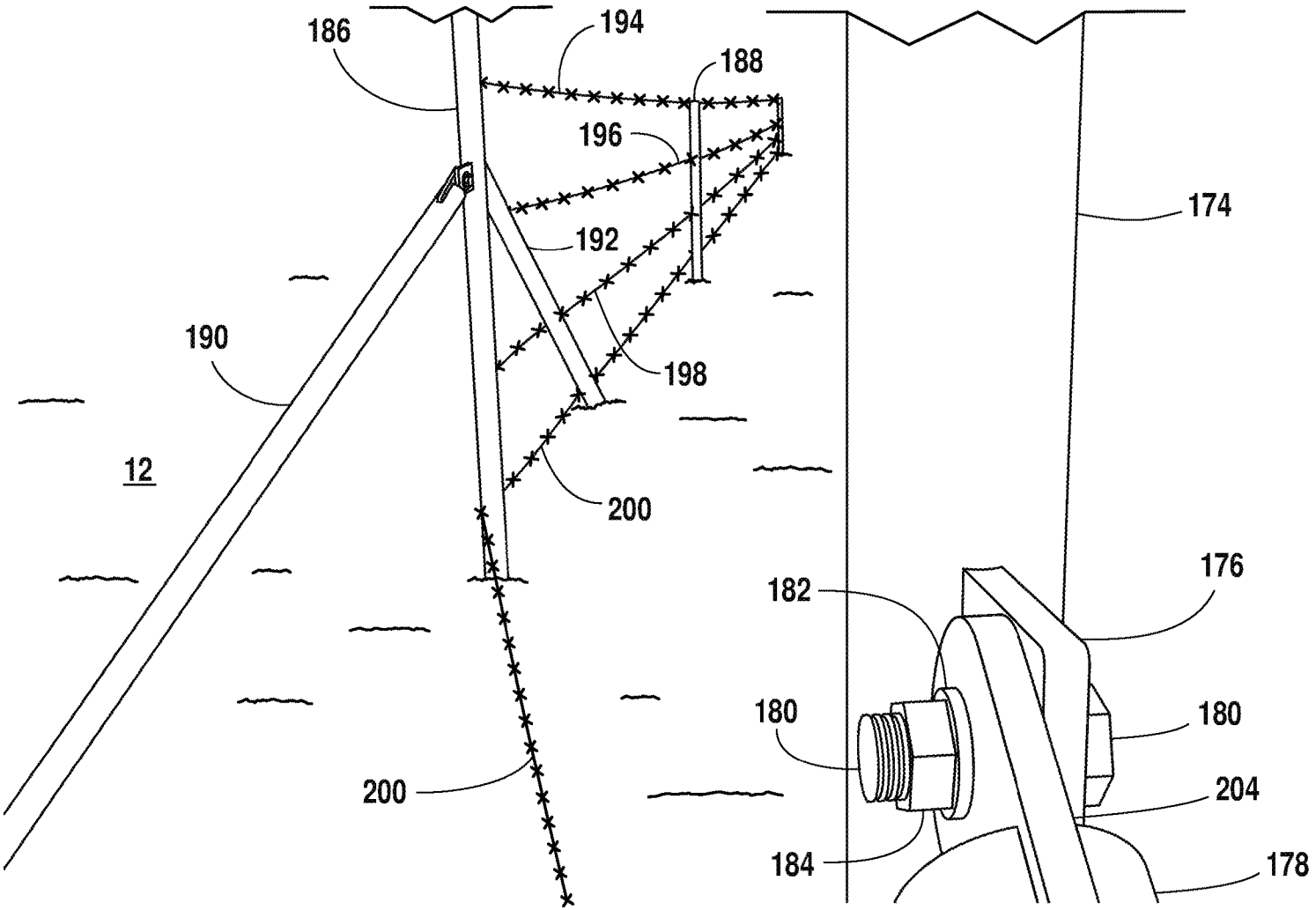
FIG. 8 depicts an embodiment of the present invention showing the fence line following the path laid by the posts of the fencing system.

Still referring to FIG. 8, intermediary post 174 is braced by brace 178 at the connection point where plate 176 of intermediary post 174 is secured to the plate of brace 178 via fastener 180, such as a bolt, using lock washer 182 and nut 184.

Figure 9:
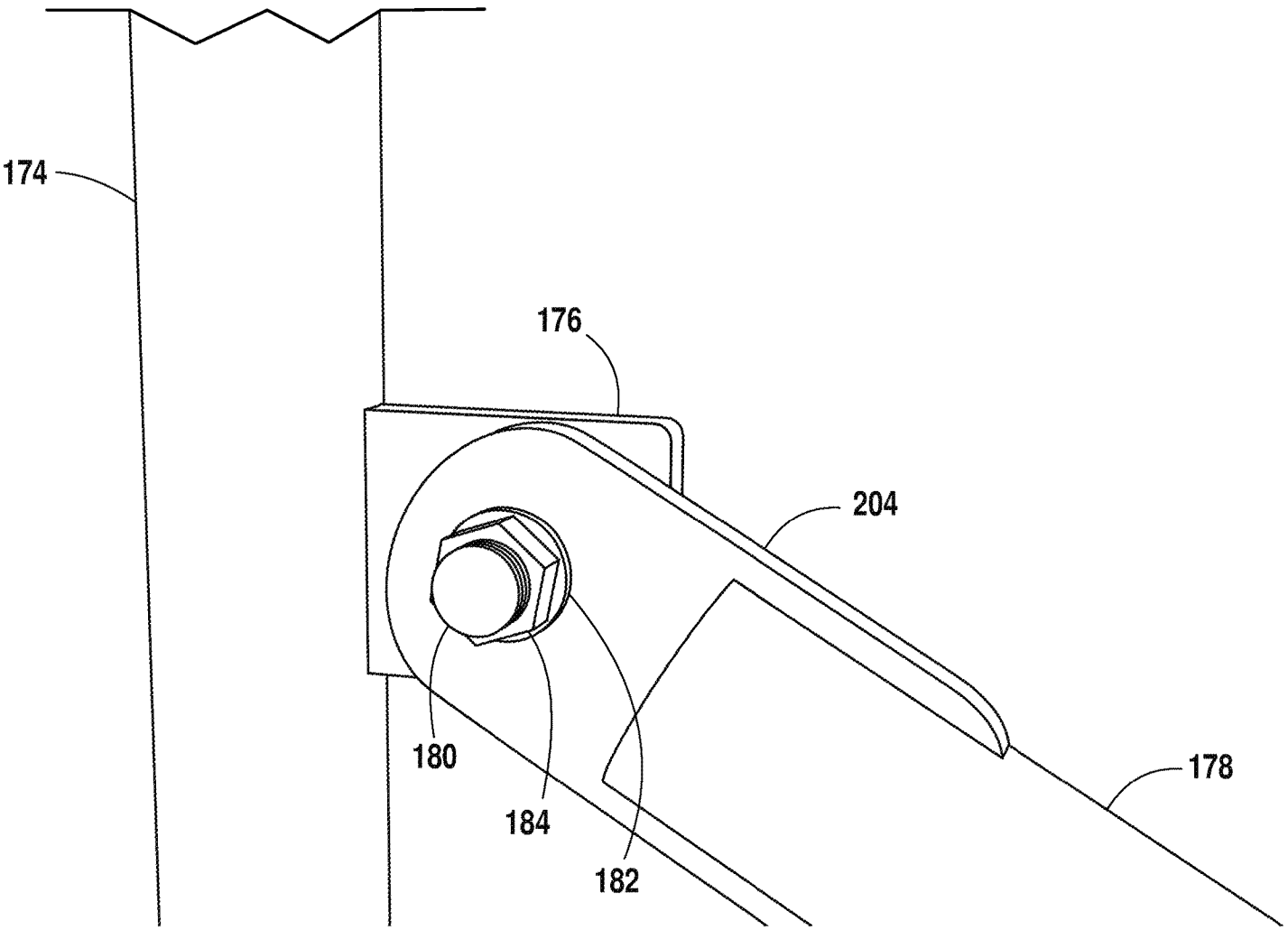
FIG. 9 is a close up of a connection point between a post and a brace demonstrating the hinging mechanism in an embodiment of the present invention.
Figure 10:
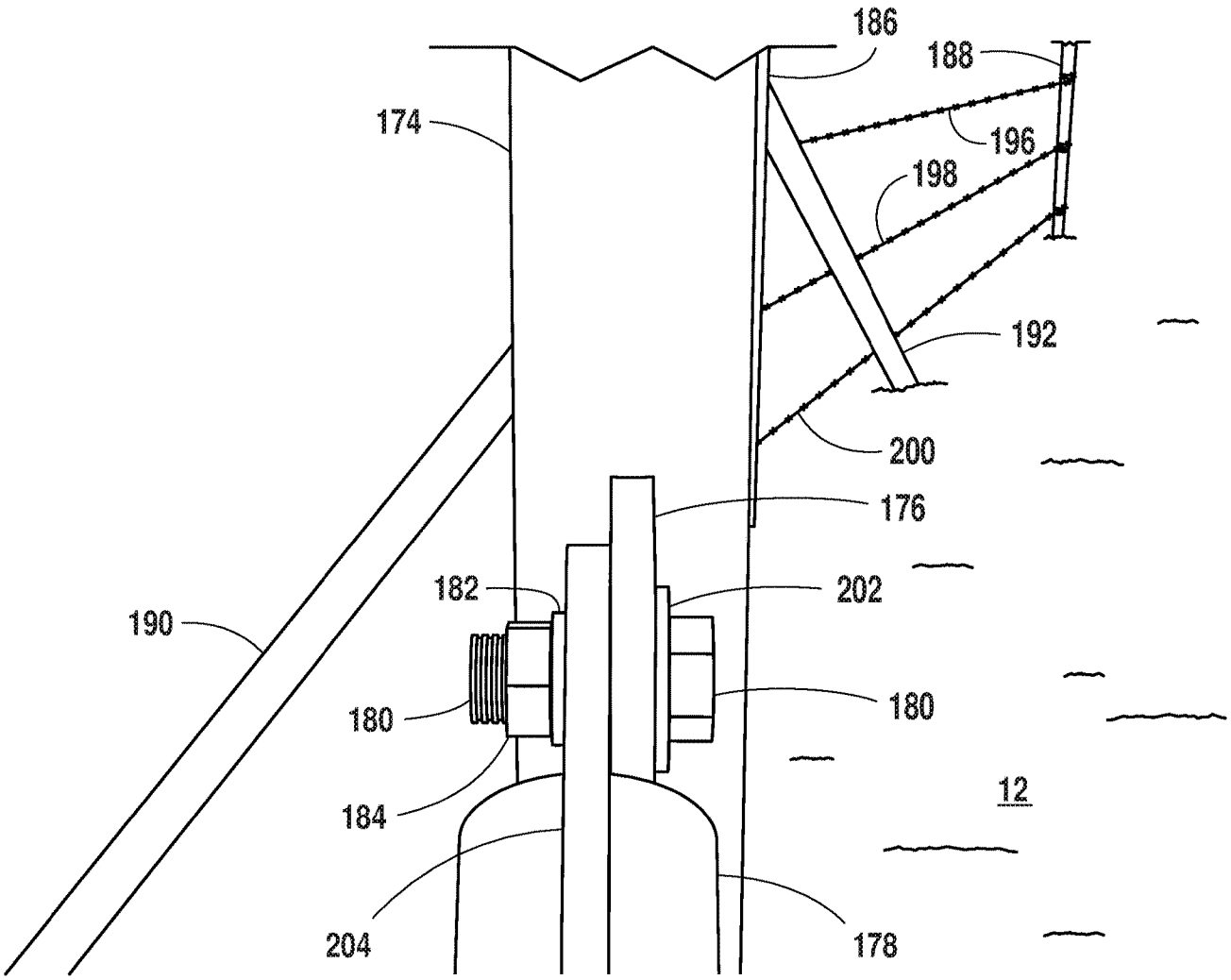
FIG. 10 is a close up of the fastening mechanism by which the braces are secured to the posts in an embodiment of the present invention.

Referring now to FIGS. 9 and 10, the hinge at the connection point between intermediary post 174 and brace 178 is shown. Plate 176 of intermediary post 174 is secured to plate 204 of brace 178 via fastener 180. On whichever side fastener is introduced to apertures (either plate 176 side or plate 204 side) washer 202 is used. Fastener 180 traverses washer 202, then apertures within plate 176 and plate 204. Nut 184 secures fastener with lock washer 182 located between nut 184 and the plate in closest proximity to nut 184. Prior to tightening, the hinge may be adjusted (either by increasing or reducing the angle formed by intermediary post 174 and brace 178, this done by rotating about the axis formed by fastener) to accommodate any discrepancies, e.g., depressions or elevations, in terrain 12.

Figure 11:
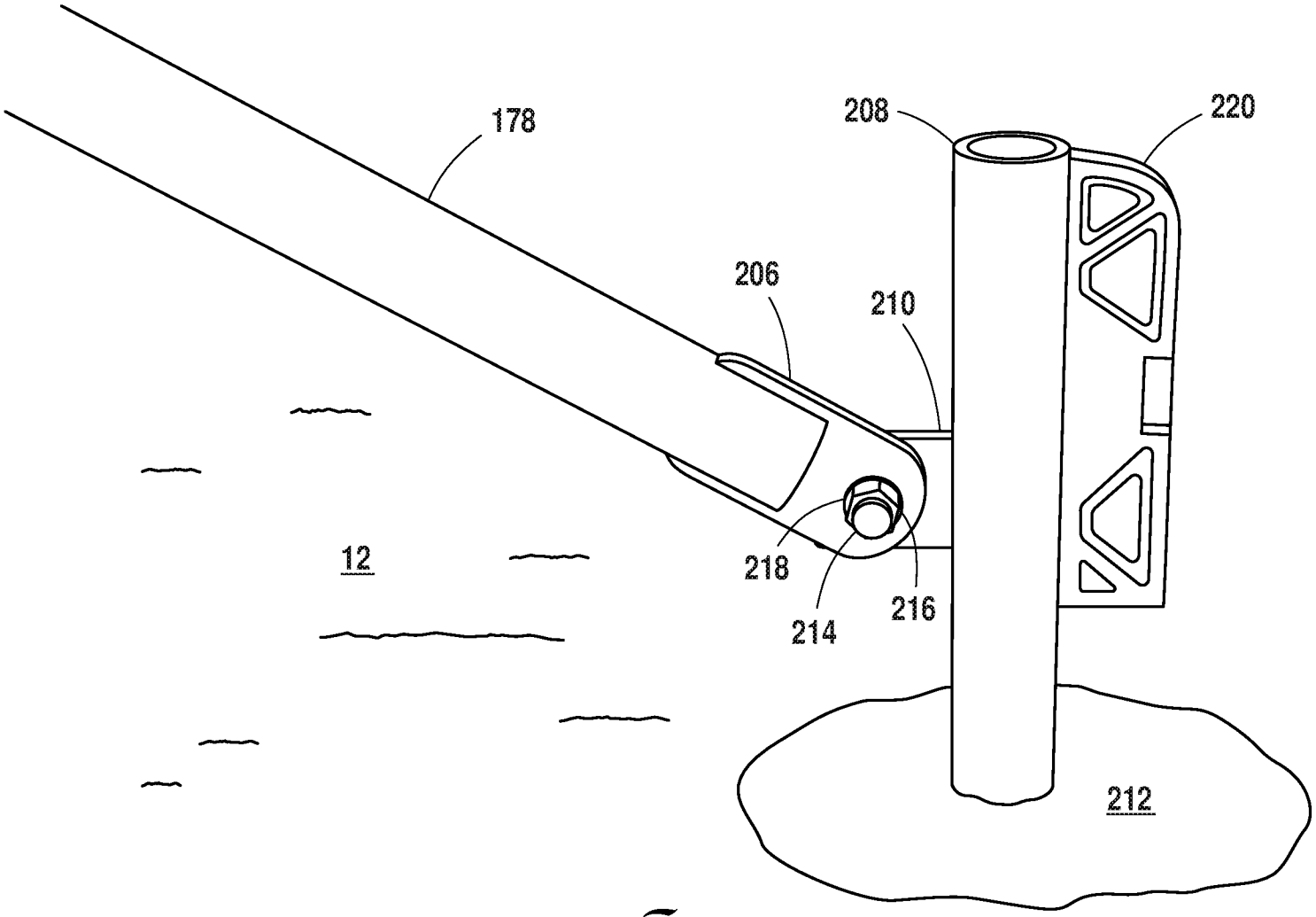
FIG. 11 is a close up of a connection point between a brace and a dead man's post within a cementitious material demonstrating the setting of a post and the hinging mechanism in an embodiment of the present invention.

Now referring to FIG. 11, a close up of the hinge action between brace 178 and brace post 208 is shown. Brace post 208 is anchored to terrain 12 via cementitious material 212. Level 220 is used to ensure vertical configuration of brace post 208 until cementitious material 212 sets. Plate 206 of brace 178 attaches to plate 210 of brace post 208 and is secured via fastener 214 using lock washer 216 and nut 218 (washer on opposite side of plate 210 not shown). Prior to fully tightening nut 218, the hinge at the connection point between brace 178 and brace post 208 is adjusted (i.e., rotated about axis formed by fastener) to accommodate the disparity in heights between brace 178 and brace post 208.

The brace of the present invention uses 2⅜ inch steel pipe, which, is preferred. The outer diameter (OD) size of the brace can range from 2⅞ inch OD pipe up to a 4 inch OD pipe. Other sizes may also be used, based upon user preference, and still remain within the contemplation of the present invention. Additionally, other comparable metal may also be used and still remain within the contemplation of the present invention. Further, while the configuration of the present invention is a pipe tube, other configurations, such as square tubing, may be utilized and still remain within the contemplation of the present invention.

The present invention uses a bolt with washer, lock washer and nut to removably fasten the brace to the post. However, other types of comparable robust fasteners, such as rivets and the like, may be used and still remain within the contemplation of the present invention.

The fencing system further includes at least one bracing post placed either along the same line as the fence or at some angle relative to the line of the fence to stabilize the posts and braces of the fence system.

The hinges formed at the connection points between the posts and the braces provide the fencing system with flexibility to adjust and be configured to negotiate various topographical terrain. For example, if the terrain is relatively flat, then there would be little need to adjust the heights of the posts and the fence as a whole would appear relatively "normal." However, if the terrain has hills and valleys, then the second post (i.e., intermediary post) would either be raised or lowered relative to the first post to negotiate the hill or valley. Subsequent intermediary posts would also either be raised or lowered relative to the prior intermediary post and this process would continue until the hill or valley has been negotiated.

This is best illustrated with reference back to FIG. 1. Fencing system 10 is shown having initial post 104 followed by several intermediary posts 106, 108, 110, 112, 114, 116 and 118 at predetermined intervals along terrain 12. Additional intermediary posts may be added as desired or as necessary. Braces 88, 90, 92, 94, 96, 98 100 and 102 connect the posts together.

At certain locations along the fence line of fencing system 10 additional reinforcement may be desired. This is accomplished through the incorporation of brace posts. For example, intermediary post 110 is braced by brace post 124 and brace post 128 with braces 126 and 130 therebetween at the bottom of a depression, as shown in FIG. 1. Intermediary post 116 is held secured via brace post 132 with brace 134 therebetween. brace posts 124, 128 and 132 are outside of the fence line and prevent intermediary posts 110 and 116 from falling away from or toward brace posts 124, 128 and 132, respectively.

Still referring to FIG. 1, as fencing system 10 moves from left to right, hinges at the connection points between the braces and posts are adjusted to negotiate the terrain. For example, braces 88 and 90 are relatively parallel to terrain 12 as terrain 12 is relatively flat. However, when there is a decrease in elevation, as shown between intermediary post 108 and intermediary post 110, the hinges at the connection points between brace 92 and intermediary post 108 and 110 are adjusted. In the case of intermediary post 108, the angle between brace 92 and intermediary post 108 is reduced (less than 90°). The angle between brace 92 and intermediary post 110 is increased (greater than 90°).

Once the topography changes again, the hinges between the next intermediary posts are again adjusted to negotiate the change in topography. For example, as terrain 12 begins to elevate, hinges at the connection point between intermediary post 110 and subsequent brace 94 are increased (i.e., the angle between intermediary post 110 and subsequent brace 94 increases). This process of continually adjusting fencing system 10 continues until the fencing system is as long as desired.

A single fencing wire 120 alone or with a second fencing wire 122 (or with even a third and fourth fencing wire) is then twisted multiple times around initial post 104 and stretched towards and either twisted or tied to the next intermediary post. This process continues along the fencing line until the desired length of fence is reached, at which point the fencing wire is tied or otherwise secured to the end post and fencing system 10 is complete.

To install, the first post is placed with at least 2 feet (and up to 3 feet) of the post below ground, and compliance with all applicable guidelines (see, e.g., FIGS. 2 and 4). The bottom of the post which will be underground is held in place using a cementitious material, such as cement (see, e.g., FIGS. 7 and 11). The present invention uses cement. However, other similar cementitious material, such as mortar, grout, concrete or the like may also be used and still remain with the contemplation of the present invention. A level may also be used to ensure the vertical configuration of each type of post used in the present invention once such posts are anchored securely to terrain 12 via cementitious material, such as concrete, and the posts are allowed to set (see, e.g., FIG. 11). Alternatively, the post may be driven into the ground through the use of an air post driver. In this instance, however, the post must be at least 4 to 5 feet underground to comply with applicable guidelines.

The present invention has 7-foot spacing between posts. However, the spacing may vary pursuant to the user's preference, e.g., 6 feet, 7 feet or 8 feet separations. The first post and the last post in a complete fencing system will include a post having a single ear or plate member distally extending therefrom with these plate members "facing each other," as shown, for example, in FIGS. 1 and 5. A dead man's post, which is a shortened post, is used as a stabilizer for the brace. Either a single dead man's post or a plurality of dead man's posts may be used, as shown in, for example, FIGS. 1, 5, 6 and 7.

The dead man's post may be located along the same axis (or line) as the fence (see, e.g., FIG. 6). At this location, the dead man's post prevents leaning (left or right; whichever direction the fence is being laid) of the posts with brace therebetween when the fence is been stretched out. The dead man's post may alternatively, or additionally, also be located at a location not along the same axis (or line) as the fence (see, e.g., FIG. 1). In this manner, the dead man's post prevents leaning in a direction transverse to whichever direction the fence is being laid. The bottom portion of the dead man's post must extend underground to the same depth as the posts (see, e.g., FIG. 4).

Any type of fence may be used with the fencing system of the present invention, including barbed wire, net or cable. Generally, a 12-gauge or 16-gauge galvanized steel material may be used. The fencing (wire, net or cable) is wrapped twice around the first post, then stretched to the next intermediary post where the fence may either be wrapped at least two times around the intermediate post or is fastened to the intermediary post via ties. In an alternative embodiment, an electrical fence may be installed over this fencing system for added security and protection. The fencing system may be expanded to however long the user desires by adding additional intermediary posts.

While the present invention describes the fencing system as having a single brace between two posts, in an alternative embodiment, there may be multiple braces between posts. The use of multiple braces between posts provides additional reinforcement and structural integrity to the fencing system of the present invention. In this alternative embodiment, the posts will also include a plurality of distally extending members equally spaced vertically along the posts, each distally extending member connected to a plate member at one end of a brace. Referring to FIG. 1, an example of use of multiple braces is shown between intermediary posts 114 and 116. Second brace 136 is below or lower than brace 98. Third brace 138 may also be included below or lower than second brace 136. If the intermediary posts 114 and 116 are high enough, a fourth brace (not shown) may also be included under or below third brace 138. While only one segment of fencing system 10 is shown using multiple braces, it is contemplated that more segments and even the entire fencing system may incorporate multiple braces between intermediary posts and still be within the contemplation of the present invention.

Figure 12A:
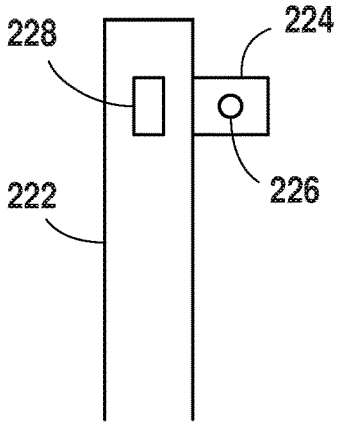
FIGS. 12A and 12B show a partial elevated and top view, respectively, of an alternative embodiment of the present invention.
Figure 12B:
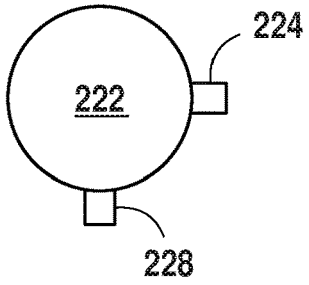

In another alternative embodiment, the posts used in the fencing system of the present invention may also include at least two plate members at 90° relative to other plate members on the same post such that the post may be used as a corner post. Referring now to FIGS. 12A and 12B, post 222 has plate member 224 having aperture 226 therein and plate member 228 (with aperture not shown), each at 90° relative to the other. FIG. 12B depicts post 222 in a top view so that the angle between the plates may be readily shown. In this instance, one fence line will extend out in one direction from post 222 and a second fence line will extend out in a second direction from post 222, wherein the angle between the first fence line and the second fence line is 90°.

Figure 13A:
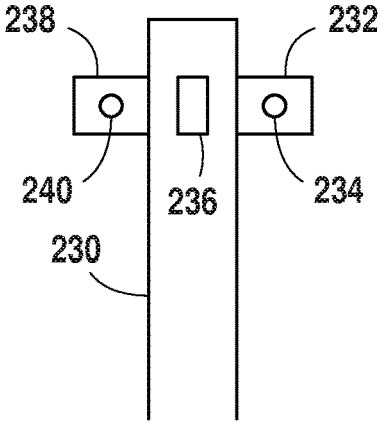
FIGS. 13A and 13B show a partial elevated and top view, respectively, of an alternative embodiment of the present invention.
Figure 13B:
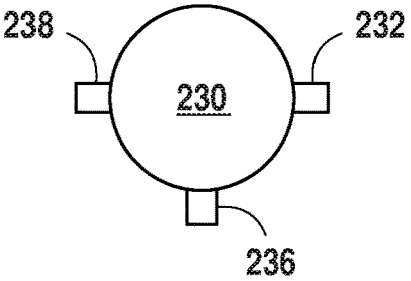

In another alternative embodiment, the posts may also include at least 3 plate members at 90° relative to other plate members on the same post such that the post may be used as an intersecting post. Referring now to FIGS. 13A and 13B, post 230 has plate member 232 having aperture 234 therein, plate member 236 (with aperture not shown), and plate member 238 with aperture 240 therein, each plate at 90° relative to the other. FIG. 13B depicts post 230 in a top view so that the angles between the plates may be readily shown. In this instance, one fence line will extend out in one direction from post 230, a second fence line will extend out in a second direction from post 230, and a third fence line will extend out in a third direction from post 230, wherein the angle between each of the first fence line, second fence line and third line is 90° relative to each other adjacent plate member.

Figure 14A:
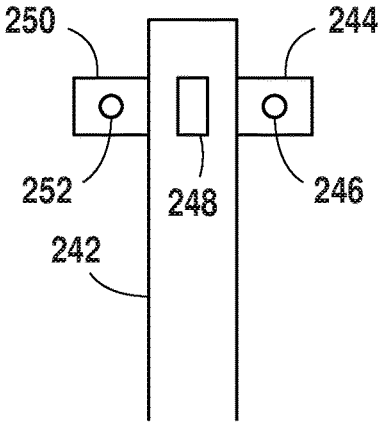
FIGS. 14A and 14B show a partial elevated and top view, respectively, of an alternative embodiment of the present invention.
Figure 14B:
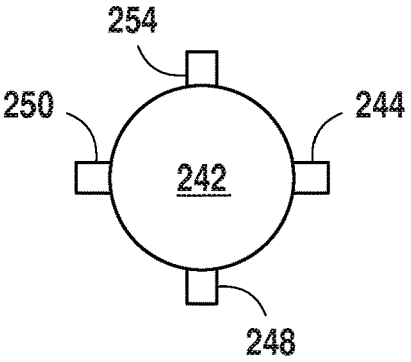

In yet another alternative embodiment, the posts may also include at least 4 plate members at 90° relative to other plate members on the same post such that the post may be used as an intersecting post. Referring now to FIGS. 14A and 14B, post 242 has plate member 244 having aperture 246 therein, plate member 248 (with aperture not shown), plate member 250 with aperture 252 therein, and plate member 254 (with aperture not shown) (see FIG. 14B), each plate at 90° relative to the other. FIG. 14B depicts post 244 in a top view so that the angles between the plates may be readily shown. In this instance, one fence line will extend out in one direction from post 242 and a second fence line will extend out in a second direction from post 242, a third fence line will extend out in a third direction from post 242, and a fourth fence line will extend out in a fourth direction from post 242, wherein the angle between each of the first, second, third and fourth fence lines is 90° relative to each other adjacent plate member.

The present invention may also be included in a kit containing the various components for the fencing system of the present invention for a certain size or length of fence (e.g., sufficient number of posts, intermediary posts, dead man's posts, braces and fencing).

While the present invention is discussed in the context of ranches, the present invention may have applications in other areas, such as farms, and for game fences. The present invention further finds application in residential and commercial settings.

The various embodiments described herein may be used singularly or in conjunction with other similar devices. The present disclosure includes preferred or illustrative embodiments of specifically described apparatuses, assemblies, and systems. Alternative embodiments of such apparatuses, assemblies, and systems can be used in carrying out the invention as described herein. Other aspects and advantages of the present invention may be obtained from a study of this disclosure and the drawings.

I claim:

1. A fencing system for negotiating topography of surfaces, said fencing system comprising:

an initial post comprising a tubular body having a plate member distally extending from an upper end thereof;

an end post comprising a tubular body having a plate member distally extending from an upper end thereof, said plate member distally extending from said end post opposite said plate member distally extending from said initial post;

at least one intermediary post, each comprising a tubular body having a plurality of plate members distally extending from an upper end thereof, each said at least one intermediary post located between said initial post and said end post;

at least one brace post, each comprising a tubular body having a plate member distally extending from an upper end thereof, wherein each said at least one brace post has a height of less than half of the height of each of said initial post, said end post, and said at least one intermediary post, wherein said initial post, said end post, said at least one intermediary post and said at least one brace post are anchored an equal predetermined distance within the ground, and wherein each said at least one brace post is outside the fence line and adjacent to a corresponding said at least one intermediary post;

a plurality of brace members, each comprising a tubular body having a plate member distally extending from each of a first end and a second end thereof, one of said brace members hingedly connecting said initial post to said at least one intermediary post, one of said brace members hingedly connecting a corresponding said at least one intermediary post to each said at least one brace post, and one of said brace members hingedly connecting said at least one intermediary post to said end post; and wherein said distally extending plate members from said first end and said second end of each said brace member are wider than said brace member, each said brace member being of uniformed thickness therethrough;

a cementitious material in communication with said bottom portion of each of said initial post, said end post, said at least one intermediary post, and of said at least one brace post, an equal distance into the ground;

at least one fencing wire in communication with said initial post, said at least one intermediary post, and said end post; and wherein all plate members are welded to said initial post, said at least one intermediary post, said at least one brace post, said brace members, and said end post; wherein said plate members each contain an aperture therein; and a plurality of fasteners for securing said brace members to said initial post, said end post, said at least one intermediary post, and said at least one brace post, each said fastener traversing said apertures of aligned and adjoining plate members of one of said brace members and a corresponding one of said initial post, said end post, said at least one intermediary post, and said at least one brace post;

wherein the interval between any two posts is within the range of 6 feet to 8 feet in length.

2. The fencing system, as recited in claim 1, wherein said plurality of plate members distally extending from said at least one intermediary post extend distally in opposite directions.

3. The fencing system, as recited in claim 2, wherein said initial post, said at least one intermediary post, said end post, said fasteners and said at least one brace are packaged in a kit.

4. The fencing system, as recited in claim 1, wherein said at least one intermediary post has a plurality of distally extending plates and wherein the angle between said plurality of distally extending plates is 90°.

5. The fencing system, as recited in claim 1, wherein said at least one intermediary post has at least two distally extending plates and wherein the angle between said at least two distally extending plates is 90°.

6. The fencing system, as recited in claim 1, wherein said at least one intermediary post has at least three distally extending plates and wherein the angle between said at least three distally extending plates is 90°.

7. The fencing system, as recited in claim 1, wherein said at least one intermediary post has at least four distally extending plates and wherein the angle between said at least four distally extending plates is 90°.

* * * * *